350-164 SR
2/7/78 XR 4,072,856

United States Patent [19] [11] 4,072,856
Eligehausen [45] Feb. 7, 1978

[54] DAYLIGHT-SIMULATING INCANDESCENT LAMP LIGHT FIXTURE, PARTICULARLY FOR MEDICAL AND DENTAL USE

[75] Inventor: Hans Eligehausen, Hanau am Main, Germany

[73] Assignee: W. C. Heraeus GmbH, Hanau am Main, Germany

[21] Appl. No.: 762,415

[22] Filed: Jan. 25, 1977

[30] Foreign Application Priority Data

Feb. 9, 1976 Germany ..... 2604921

[51] Int. Cl.[2] ..... F21M 7/00

[52] U.S. Cl. ..... 362/2; 350/164; 362/327; 362/343

[58] Field of Search ..... 240/1.4, 41.15, 41.35 R, 240/41.1, 103, 1 LP; 350/164, 292, 293

[56] References Cited

U.S. PATENT DOCUMENTS

| | | | |
|---|---|---|---|
| 2,629,046 | 2/1953 | Liberman | 240/103 R |
| 3,666,939 | 5/1972 | Ota | 240/41.15 |
| 3,829,197 | 8/1974 | Thelen | 350/164 |
| 3,839,129 | 10/1974 | Neumann | 350/293 X |
| 3,847,585 | 11/1974 | Chisholm | 350/164 X |
| 3,922,068 | 11/1975 | Uetsuki | 350/164 |
| 3,936,136 | 2/1976 | Ikeda et al. | 350/164 X |
| 3,978,273 | 8/1976 | Groth | 350/164 X |

*Primary Examiner*—Peter A. Nelson
*Attorney, Agent, or Firm*—Flynn & Frishauf

[57] ABSTRACT

To permit employment of an incandescent lamp of about 3000° K color temperature as a light source, the reflector reflecting light to the use area, typically an operating table, a dental chair, or the like, is constructed of a material such as glass having an index of refraction of 1.425 to 1.575, the glass readily permitting passage of infrared radiation. To provide reflected light which corresponds at least approximately to daylight, with a color temperature of 6000° K, the glass is coated with a sequence of materials as set forth in table I, the materials being applied to the glass in the sequence given with increasing distance from the glass carrier, resulting in an overall reflected light of about 5500° K.

13 Claims, 4 Drawing Figures

Figure 1:
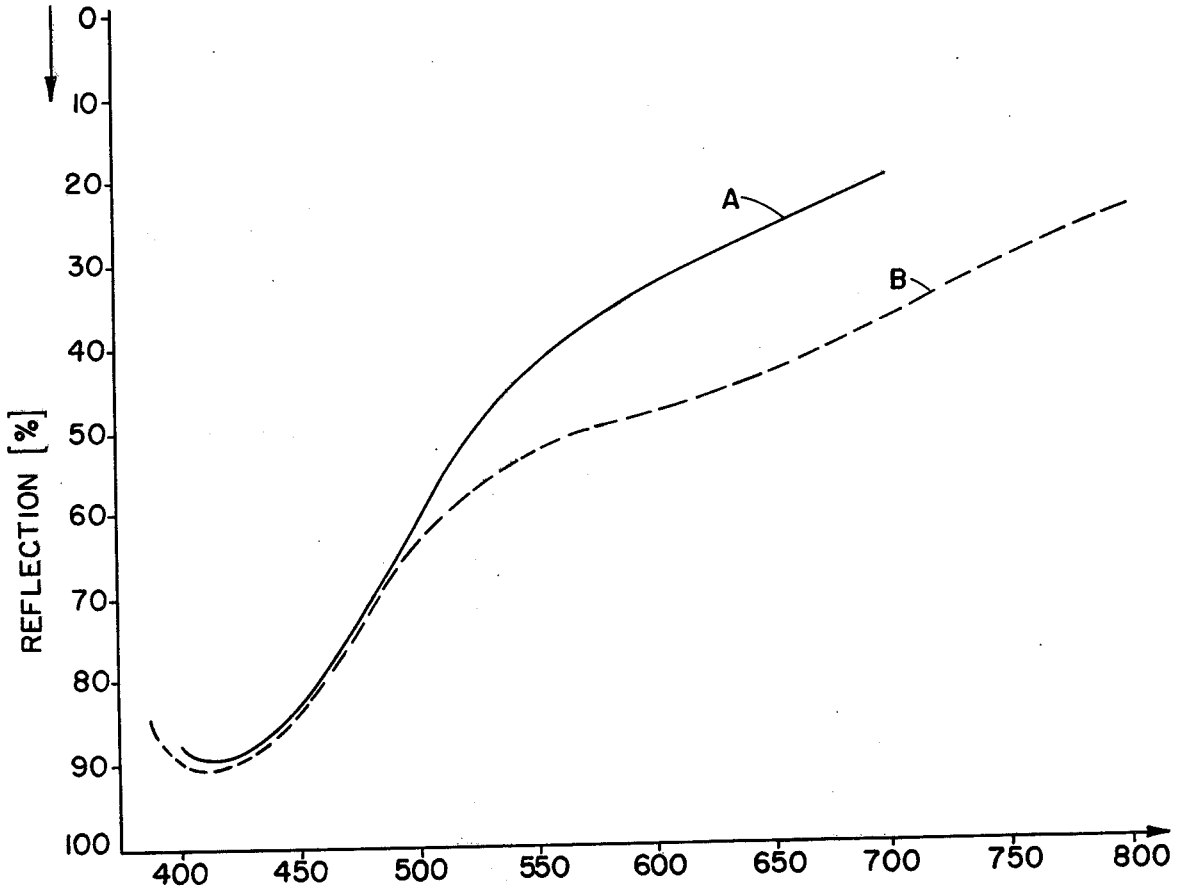

DAYLIGHT-SIMULATING INCANDESCENT LAMP LIGHT FIXTURE, PARTICULARLY FOR MEDICAL AND DENTAL USE

The present invention relates to a light fixture, particularly for medical or dental use, such as an operating room light, a dental examination light, or the like, using an incandescent lamp as a light source.

Incandescent lamps radiate light at a color temperature of about 3000° K. In order to provide a better match to daylight, it has been customary to use filters between the light source and the object or region to be illuminated. Such lights customarily employ a reflector and a shield, typically with an inside mirror portion to prevent direct illumination of the field to be illuminated. The light fixture, as customary, uses filters in order to match the light emitted from the incandescent lamp to the desired color temperature. The filters absorb a portion of the light emitted from the light source, typically an incandescent lamp, and form an additional element of the fixture. Special precautions must be undertaken to remove the heat due to absorption of infrared radiation. A substantial amount of heat is generated by conventional high intensity lamps since a major portion of electrical energy applied to incandescent lamps is converted to heat. The object or region to be irradiated must not be heated excessively; tissue portions must not dry out or be exposed to intense heat merely in order to provide light thereto. This is particularly important in medical and dental applications. The light projected on the region to be illuminated which is filtered by a single filter, or by filter combinations, usually has a color temperature of about 4200° to 4300° K; it would be desirable to provide a better match of the light to daylight which has a color temperature of about 6000° K.

It is an object of the present invention to provide a light fixture or illumination system, particularly for medical or dental use, in which the light impinging on the field to be illuminated is better matched to ordinary daylight, that is, has a color temperature which is as close to daylight as possible and additionally permits elimination of the infrared portion of the radiation emitted by the incandescent lamp, or at least to render this infrared portion ineffective with respect to the field to be illuminated.

Subject matter of the present invention: Briefly, the light-emitting system uses an incandescent lamp of customary type, for example emitting light at about 3000° K. The incandescent lamp is placed behind a reflecting shield to shield the field to be illuminated from direct radiation by the lamp. A reflector is provided which, in accordance with the invention, has the following characteristics: It uses a material which is well adapted to pass infrared radiation; such a material, for example, is glass having an index of refraction $n_d$ of about 1.425 to about 1.575. The glass forms a carrier for a sequence of layers which are set forth in the attached table I. These layers are applied in the sequences 1 through 6 at the side facing the incandescent lamp, at the side opposite the incandescent lamp, or to both sides, and are listed in increasing distance from the carrier substrate, typically the glass.

Figure 2:
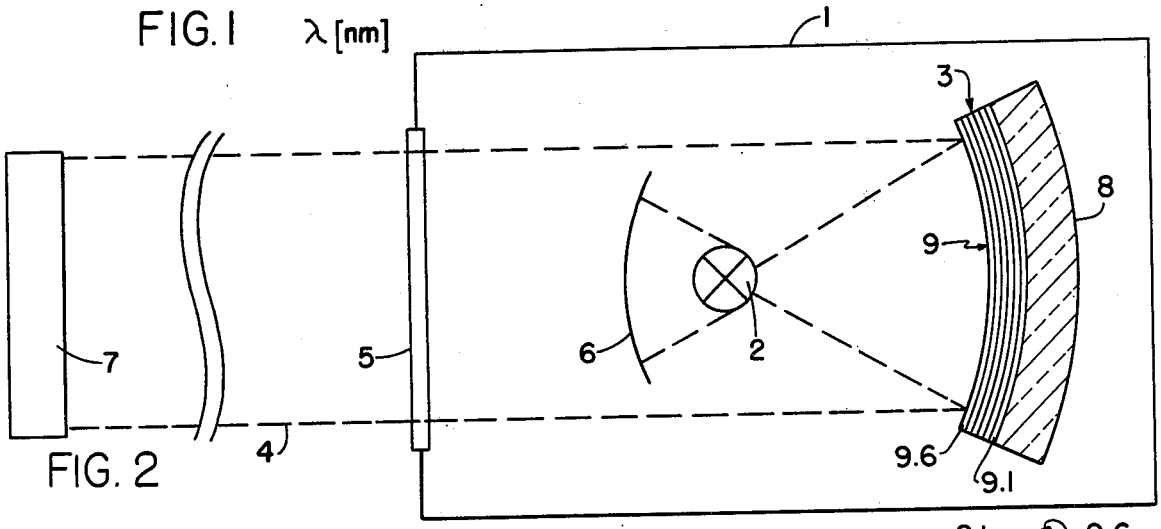

The invention will be described by way of example with reference to the accompanying drawings, wherein:

FIG. 1 depicts two graphs comparing the performance of the lamp in accordance with the present invention with lamps of the prior art; and FIG. 2 is a highly schematic diagram of an illumination system and of a light source suitable, for example, for dental or medical use.

The lamp of FIG. 2, which forms a vertical sectional schematic illustration, generally has a housing 1 in which an incandescent lamp 2 is positioned, the incandescent lamp 2 being mounted, and supplied with electric power as well known. The incandescent lamp is positioned in front of a reflector 3 which has the characteristics of the present invention. An opening in the housing is closed off by a light-transmissive disk 5 made of a material with high light transmissivity for visible radiation, typically glass. The beam of light is indicated generally by the broken lines 4. A reflecting shield 6 is located between the incandescent lamp 2 and the disk 5 in order to prevent direct illumination of the field 7 which is to be illuminated, by direct rays from lamp 2. The shield 6, preferably, is a mirror.

The reflector 3 consists of a carrier 8 of a material passing infrared radiation, typically glass. A plurality of layers 9 are applied to the glass, for example by evaporation or sputtering. Six layers are applied, 9.1 to 9.6, of which only the first and the last are numbered for simplicity of illustration. The layers essentially have the general characteristics of table I. A preferred form of glass and layers is shown in table II.

The reflector 3 in accordance with the present invention provides a spectral distribution of reflected light within the visible spectral range which corresponds to a color temperature of bout 5500° K, when irradiated by customary or ordinary incandescent lamps having a color temperature of about 3000° K. The match of the radiation from such an incandescent lamp to the color temperature of 5500° K, which thus provides an excellent approximation of daylight, is best seen by considering the curves of FIG. 1.

Curve A illustrates the values of reflected energy available, theoretically, from a light source emitting light at a color temperature of 3000° K in which the color temperature is increased to 5500° K; curve B illustrates the actual radiation received by means of the reflector in accordance with the present invention when exposed to incandescent lamp radiation in which the incandescent lamp has a color temperature of about 3000° K. The curve is plotted in percent reflected light vs. wave length in nm. The transmissivity of the reflector for infrared (IR) radiation is approximately 90%, so that heating of the operating field is reliably prevented. Heating of the operating field should be avoided to prevent drying of tissue. The IR radiation passing through the reflector can be removed easily and as well known, for example by external cooling; since this radiation is behind the reflector, suitable heat-removing means will not interfere with light transmission, and application to the field 7. The heat can thus be removed, or rendered harmless, without affecting the field 7 to be illuminated or in any way influencingg the field 7 directly in order to remove the heat, which was not possible when using absorption filters, or filter combinations.

The layers applied to the IR radiation-transmissive carrier material 8, essentially as set forth in table I and, in the preferred form, in table II, provides the desirable characteristics when combined as set forth. The carrier 8 should have an index of refraction as set forth, that is $n_d$ of about 1.425 to about 1.575. Adhesion of the sequence of layers of glass is excellent; the layers are mechanically hard and tough and chemically extremely stable, so that they have a long lifetime.

The illuminating system can be used particularly in medical fields and especially where illumination of the field matching daylight is particularly important, without providing heating at the illuminating field, this is important for operating room lights. Another particularly suitable use of the system is for dental lights, and especially in those fields in which the dentist is to match the color of an artificial tooth to adjacently located natural, or other teeth, so that the overall match of the eventual set of teeth of the patient will be good and not influenced by the particular illumination surrounding the patient.

With respect to Table I it is stated that for each layer 9.1 to 9.6 the value of the index of refraction $n_d$ increases as the thickness of the layer increases.

The replacement in layer 9.1 of tantalum oxide by niobium oxide or zirconium oxide has practically no effect on the value of reflected energy, but tantalum oxide is preferred because of its easier evaporation when the vapor-deposition method is used for producing the layer.

The replacement of silicon dioxide by magnesium fluoride in the layers 9.2, 9.4 and 9.6 of Table I will result in a slight increase in the value of reflected energy.

Replacement of the preferred titanium dioxide by zinc sulfide in the layers 9.3 and 9.5 of Table I will result in a slight decrease in the value of reflected energy.

The resistivity of the layer system against chemical or mechanical influences is extremely good if silicon dioxide is used as material for the layers 9.2, 9.4 and 9.6 and titanium dioxide for the layers 9.3 and 9.5. A reflector consisting of a concave carrier and a plurality of layers on the concave side of the carrier facing the incandescent lamp, as shown in FIG. 2, has the advantage over a reflector with a plurality of layers on the convex side of the carrier, i.e. opposite the incandescent lamp, as shown in FIG. 3A, in that it is easier to produce deposits by evaporation on a concave bent surface than on a convex bent surface.

Figure 3A:
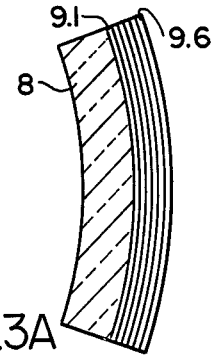
Figure 3B:
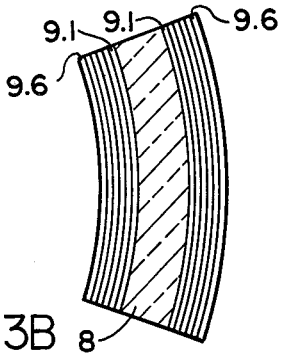

In FIGS. 3A and 3B are shown schematically two other types of reflectors each of which may replace reflector 3 in the schematic diagram of FIG. 2.

In FIG. 3A the plurality of layers 9.1 to 9.6 is deposited on the convex surface of carrier 8, which surface is located on the side opposite an incandescent lamp.

FIG. 3B shows a type of a reflector having a plurality of layers 9.1 to 9.6 at the side of the carrier 8 facing an incandescent lamp and at the side opposite of said incandescent lamp.

Various changes and modifications may be made within the scope of the inventive concept.

Table I

| Layer No. | Layers 9.1 to 9.6, in Sequence of Increasing Distance from Carrier 8: Index of Refraction | Thickness of Layer | Material |
|---|---|---|---|
| | $n_d$ | A | |
| 9.1 | 1.9 to 2.1 | 1020 to 1120 | tantalum, niobium oxide or zirconium oxide |
| 9.2 | 1.4 to 1.5 | 665 to 735 | silicon dioxide or magnesium fluoride |
| 9.3 | 2.4 to 2.6 | 400 to 440 | zinc sulfide or titanium di-oxide |
| 9.4 | 1.4 to 1.5 | 665 to 735 | silicon dioxide or magnesium fluoride |
| 9.5 | 2.4 to 2.6 | 400 to 440 | titanium di-oxide or zinc sulfide |
| 9.6 | 1.4 to 1.6 | 1050 to 1155 | silicon dioxide or magnesium fluoride |

Table II

| No. | Preferred Embodiment: Index of Refraction | Thickness of Layer | Material |
|---|---|---|---|
| | $n_d$ | A | |
| 9.1 | 2.0 | 1070 | tantalum oxide |
| 9.2 | 1.5 | 700 | silicon dioxide |
| 9.3 | 2.6 | 420 | titanium dioxide |
| 9.4 | 1.5 | 700 | silicon dioxide |
| 9.5 | 2.6 | 420 | titanium dioxide |
| 9.6 | 1.5 | 1100 | silicon dioxide |
| substrate carrier 8 | 1.5 | $10^7$ nm | glass |

I claim:

1. Reflector structure to provide reflected light matching at least approximately daylight when illuminated by a source of radiation having a color temperature of about 3000° K, comprising a substrate carrier (8) of a material highly pervious to infrared radiation and having an index of refraction $n_d$ of between about 1.425 to 1.575;

and a series of layers (9.1 - 9.6) applied to at least one side of said carrier substrate, in increasing distance from said substrate carrier, said layers comprising

| Layer No. | Index of Refraction | Thickness of Layer | Material |
|---|---|---|---|
| | $n_d$ | A | |
| 9.1 | about 1.9 to/2.1 | about 1020 to/1120 | tantalum, niobium or zirconium oxide |
| 9.2 | about 1.4 to/1.5 | about 665 to/735 | silicon dioxide or magnesium fluoride |
| 9.3 | about 2.4 to/2.6 | about 400 to/440 | zinc sulfide or titanium oxide |
| 9.4 | about 1.4 to/1.5 | about 665 to/735 | silicon dioxide or magnesium fluoride |
| 9.5 | about 2.4 to/2.6 | about 400 to/440 or | titanium oxide zinc sulfide |
| 9.6 | about 1.4 to/1.6 | about 1050 to/1155 | silicon dioxide or magnesium fluoride |

2. Reflector structure according to claim 1, wherein the substrate carrier (8) comprises glass.

3. The reflector structure of claim 1 in combination with an incandescnet light source of 3000° K and located to be irradiated by said light source.

4. Daylight-simulating incandescent lamp fixture, particularly for medical and dental use, comprising an incandescent lamp emitting radiation having a color temperature of about 3000° K;

a reflector structure (3) as claimed in claim 1;

a reflecting shield (6) directing radiation from said incandescent lamp unto said reflector structure;

and means (5) passing light reflected from said reflector structure, the reflecting shield (6) being located between said light-passing means and said reflector structure to prevent passage of direct radiation from said incandescent lamp through said light-passing means (5).

5. Fixture according to claim 4, wherein the reflecting shield (6) comprises a mirror.

6. Reflector structure according to claim 1, wherein the substrate carrier (8) comprises glass of about at least $10^7$ A thickness and having an index of refraction $n_d$ of about 1.5, and the layers about as set forth in table II.

7. Light fixture according to claim 4, wherein the substrate carrier (8) comprises glass of about at least $10^7$ A thickness and having an index of reflection $n_d$ of about 1.5, and the layers about as set forth in table II.

8. Light fixture according to claim 7, wherein the reflecting shield (6) comprises a mirror.

9. Light fixture according to claim 4, wherein said substrate (8) is glass, and said layers (9.1 - 9.6) are applied to the side of the substrate facing the incandescent lamp (2).

10. Light fixture according to claim 4, wherein said substrate (8) is glass and said layers (9.1 - 9.6) are applied to the side of the glass opposite that facing the incandescent lamp (2).

11. Light fixture according to claim 4, wherein said substrate (8) is glass and two sets of layers are provided, one layer being applied to the side of the glass facing the incandescent lamp (2) and the other layer being applied to the obverse side of the glass substrate (8).

12. The reflector structure of claim 1, wherein the first layer (9.1) is tantalum oxide; the second, fourth and sixth layer (9.2, 9.4, 9.6) are silicon dioxide; and the third and fifth layers (9.3, 9.5) are titanium dioxide.

13. Light fixture according to claim 4, wherein the first layer (9.1) is tantalum oxide; the second, fourth and sixth layers (9.2, 9.4, 9.6) are silicon dioxide; and the third and fifth layers (9.3, 9.5) are titanium dioxide.

* * * * *